US005339643A

United States Patent [19]

Pikaart

[11] Patent Number: 5,339,643

[45] Date of Patent: Aug. 23, 1994

[54] METHOD FOR DEFROSTING A LABORATORY FREEZER DOOR

[75] Inventor: Jeffrey A. Pikaart, Hamilton, Mich.

[73] Assignee: Venturedyne Limited, Milwaukee, Wis.

[21] Appl. No.: 90,650

[22] Filed: Jul. 12, 1993

[51] Int. Cl.[5] ..... F25D 21/00

[52] U.S. Cl. ..... 62/80; 62/272; 62/298

[58] Field of Search ..... 62/80, 272, 273, 298, 62/440, 441, 448, 449

[56] References Cited

U.S. PATENT DOCUMENTS

| | | | |
|---|---|---|---|
| 2,537,314 | 1/1951 | Mortensen | 62/89 |
| 3,094,851 | 6/1963 | Beckwith | 62/256 |
| 3,177,678 | 4/1965 | Facey, Jr. | 62/272 |
| 3,858,408 | 1/1975 | Kenyon | 62/283 |
| 4,603,558 | 8/1986 | McAdams | 62/272 |
| 4,781,031 | 11/1988 | McElvany | 62/272 X |

*Primary Examiner*—Harry B. Tanner

*Attorney, Agent, or Firm*—Jansson & Shupe, Ltd.

[57] ABSTRACT

The disclosure involves a method for defrosting an inner door of a laboratory freezer having (a) a plurality of inner doors, each closing a separate compartment, and (b) an outer door covering the inner doors. The method includes the steps of opening the outer door, removing at least one inner door, closing the outer door and defrosting the removed inner door. In that way, an inner door is defrosted without disturbing the contents of the freezer and, particularly, the contents of the compartment from which the door is removed. Optionally, the freezer user may keep a spare inner compartment door on hand and use it to immediately replace the removed door before closing the outer door. Door defrosting steps and a new hinge mechanism facilitating quick door removal are also disclosed.

12 Claims, 3 Drawing Sheets

METHOD FOR DEFROSTING A LABORATORY FREEZER DOOR

FIELD OF THE INVENTION

This invention relates generally to refrigeration and, more particularly, to cold-storage freezers.

BACKGROUND OF THE INVENTION

Freezers are used for a wide variety of purposes including for storage of food products, of materials being tested and for long-term storage of animal and human tissue and fluids. The precautions taken for each type of storage vary with the criticality of the integrity of the freezer contents.

An aspect of freezer operation with which the user must sooner or later contend involves the formation of frost. Frost impairs the ability of the freezer to retain an optimum cold temperature and, with sufficient frost buildup, can prevent tight door closure. An ill-fitting door permits warm air to migrate into the cold compartment and impair the quality of the stored contents.

At or near one end of the criticality "spectrum" are food freezers, both residential and commercial. Unless special equipment configurations are employed, the usual procedure for remedying an "over-frosted" freezer is to remove the freezer contents to other cold storage, shut down the freezer and either scrape away frost or simply let it melt as the freezer warms to room temperature.

The prior art includes some of the special equipment configurations used to help avoid total freezer shutdown. For example, U.S. Pat. No. 3,858,408 (Kenyon) relates to detachable frost shields mounted tightly against the surface of the permanent liner of a food cooler, e.g., a refrigerated ice cream cabinet.

U.S. Pat. No. 4,603,558 (McAdams) relates to a chest-type food freezer and is directed to a separate, conformably-shaped container placed into the freezer. During defrosting, the container contents are removed.

But with a food freezer, the worst that can occur in the event of heavy frost buildup is that a batch of food is ruined. However, such ruined food is replaceable at fairly nominal expense.

Laboratory freezers are at the other end of the spectrum in terms of criticality of the integrity of the freezer contents. This is so because of the types of items required to be stored without significant deterioration. Consider, for example, that laboratory freezers contain specimens of human tissue and fluids which may be vital for diagnosis, for long-term patient treatment strategies or as evidence in a legal proceeding. Such specimens may be irreplaceable, either per se or as reflective of a condition of the person at the time the specimen was taken.

For some time, companies have manufactured and sold freezers for ultra-low temperature storage of laboratory specimens. Such freezers are available in chest and upright type and Thermotron Industries of Holland, Mich., is the leading manufacturer of such freezers.

Upright freezers have a single outer door covering several inner compartment doors, each of which can be separately opened without disturbing the door of any other compartment. While the inner doors are typically made of metal, the compartment liner is sheet steel and the "rim" around each compartment opening is of plastic. And until the advent of the Thermotron invention, the inner doors were permanently attached to the freezer and could not be removed except, presumably, by using tools.

When an inner compartment door is opened, ambient air (with its "entrained" water vapor) migrates toward and around such door and the compartment opening. Because the door is extremely cold and because it is made of metal, moisture tends to condense and freeze on such door, especially the door edges. Over a short time, the inevitable frost buildup makes the door difficult to close and seal properly against the compartment rim.

When that occurs, it has been necessary to either scrape or melt away the frost. This often necessitates moving the compartment contents to another freezer or to an alternate storage area cooled by, say, liquid nitrogen. The invention addresses this problem in a unique way.

OBJECTS OF THE INVENTION

It is an object of the invention to provide an improved method for defrosting a laboratory freezer door which overcomes some of the problems and shortcomings of the prior art.

Another object of the invention to provide an improved method for defrosting a laboratory freezer door which obviates the need for "sacrificial" components or air "curtains" or the like.

Another object of the invention to provide an improved method for defrosting a laboratory freezer door which minimizes the time the compartment contents are exposed to ambient air.

Yet another object of the invention to provide an improved method for defrosting a laboratory freezer door which, in some variations, eliminates the need for additional freezer components.

Still another object of the invention to provide an improved method for defrosting a laboratory freezer door which avoids having to move compartment contents to other cold storage facilities.

Another object of the invention to provide an improved method for defrosting a laboratory freezer door which helps maintain the integrity of the freezer contents.

Another object of the invention to provide an improved method for defrosting a laboratory freezer door which can be carried out without the use of tools. How these and other objects are accomplished will become apparent from the following descriptions and the drawing.

SUMMARY OF THE INVENTION

The invention involves a method for defrosting an inner door of a laboratory freezer of the type having (a) a plurality of inner doors, each closing a separate compartment, and (b) an outer door covering the inner doors. The method includes the steps of opening the outer door, removing at least one inner door, closing the outer door and defrosting the removed inner door. In this way, an inner door is defrosted without disturbing the contents of the freezer and, particularly, without disturbing the contents of the compartment from which the door is removed.

Defrosting of the removed door(s) is in any of a variety of preferred ways. In one aspect of the novel method, the defrosting step includes retaining the removed inner door in a space, the ambient temperature of which is above the freezing point of water. Such space may be the room in which the freezer is located or may be another room.

Defrosting may also be by rinsing the removed inner door in a liquid, e.g., tap water, the temperature of which is above the freezing point of water. Or defrosting may be by applying a gas, e.g, air, to the removed inner door. The temperature of such gas is above the freezing point of water and, most preferably, the gas is heated for expeditious defrosting.

The new method contemplates a number of variations. In the method outlined above, the inner compartment from which the door is removed is devoid of a door while such door is being defrosted. This variation is quite satisfactory if the freezer is entered only occasionally. There is then little or no risk of the contents of the compartment "sans door" becoming impaired by exposure to ambient air.

On the other hand, if there is a reasonable possibility that the outer door may be opened (especially, opened frequently) before the removed door is defrosted and replaced, the user may wish to stock one or more spare doors. In that event, the inner door removing step is followed by the step of replacing the removed inner door with a spare frost-free door.

The user may find that more than one inner door needs defrosting at a particular time. In a variation of the method, the door removing step includes removing a first inner door and further includes the steps of removing a second inner door and in either order, replacing the removed inner doors with frost-free doors. The defrosting step includes defrosting both removed inner doors.

In another variant of the method (and irrespective of whether there are several inner doors to remove and defrost), the door removing step includes removing a first inner door and further includes the steps of replacing the removed first inner door with a frost-free door, then removing a second inner door and replacing the removed second inner door with a frost-free door. The defrosting step includes defrosting both removed inner doors. In this variant, the contents of each inner compartment from which doors are removed are exposed to ambient air for a minimum time since a removed inner door is immediately replaced with a frost-free door before proceeding to remove the next inner door.

In a highly preferred method, the door removing step includes detaching the inner door from the freezer without the use of tools. In a freezer well suited for carrying out the new method, at least one of the inner doors has a hinge mechanism including a first hinge component attached to the freezer and a second hinge component attached to the inner door. The door removing step includes the step of grasping the inner door and urging the second hinge component away from the first hinge component, thereby detaching the inner door.

An arrangement facilitating speedy inner door removal without tools, one of the hinge components (e.g., that attached to the freezer) includes a pin-like projection and the other hinge component (e.g., that attached to an edge of the inner door) includes a ferrule-like tube for receiving the projection. The inner door (with its attached hinge component) is lifted slightly upward to "clear" the projection and the tube from one another. Detachment is in seconds and without the use of tools.

Other aspects of the invention will become apparent from the following detailed description and from the drawing.

DETAILED DESCRIPTION OF PREFERRED EMBODIMENTS

Figure 1:
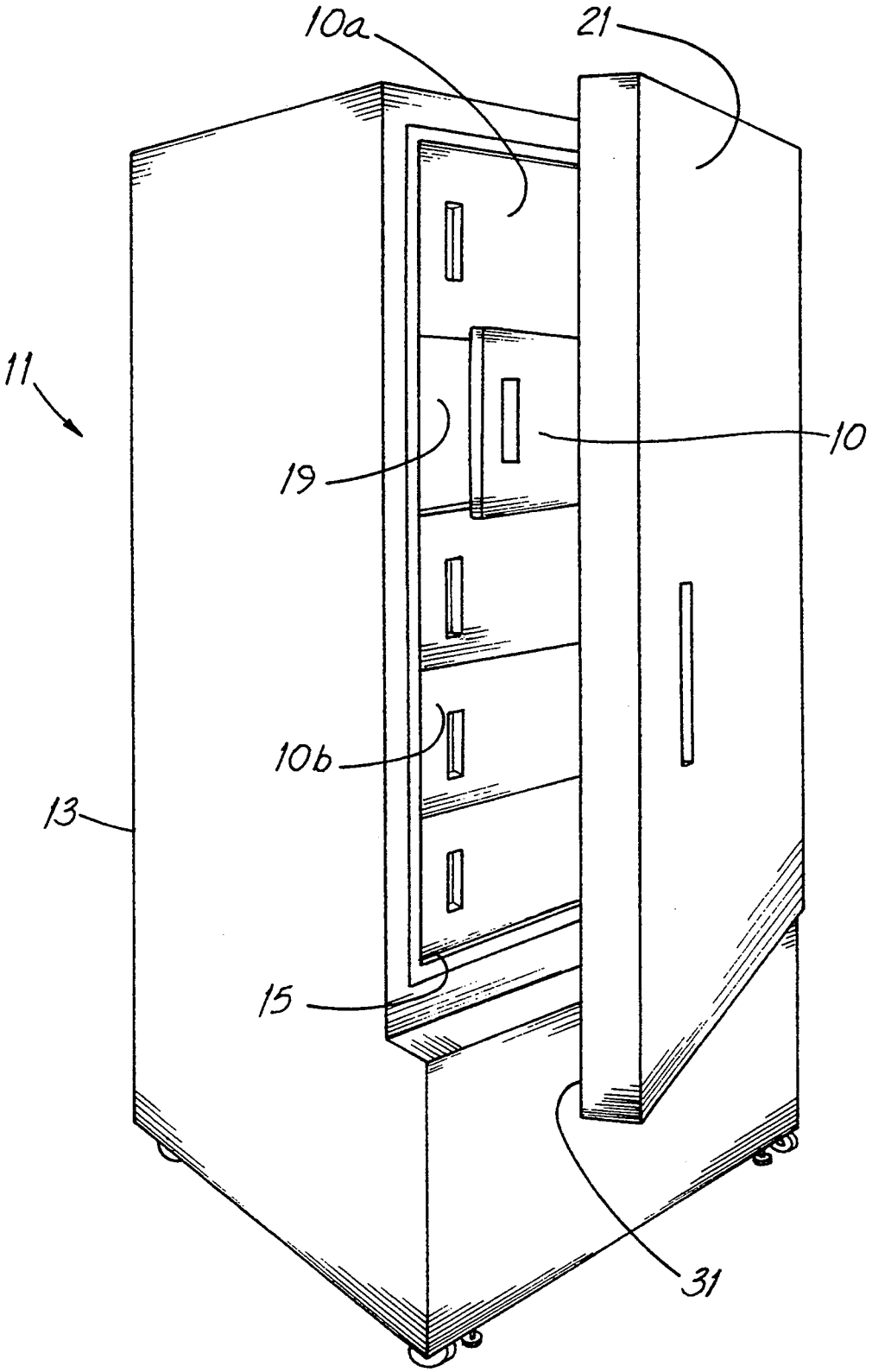
FIG. 1 is a perspective view of a laboratory freezer.

The invention involves a method for defrosting an inner door of a laboratory freezer 11 like that shown in FIG. 1. Such exemplary freezer 11 includes an upright, box-like cabinet 13 having an interior cavity 15. While the invention is described in connection with an upright freezer 11, those of ordinary skill will, after appreciating the specification, understand how to adapt the invention to chest and other types of freezers.

Figure 2:
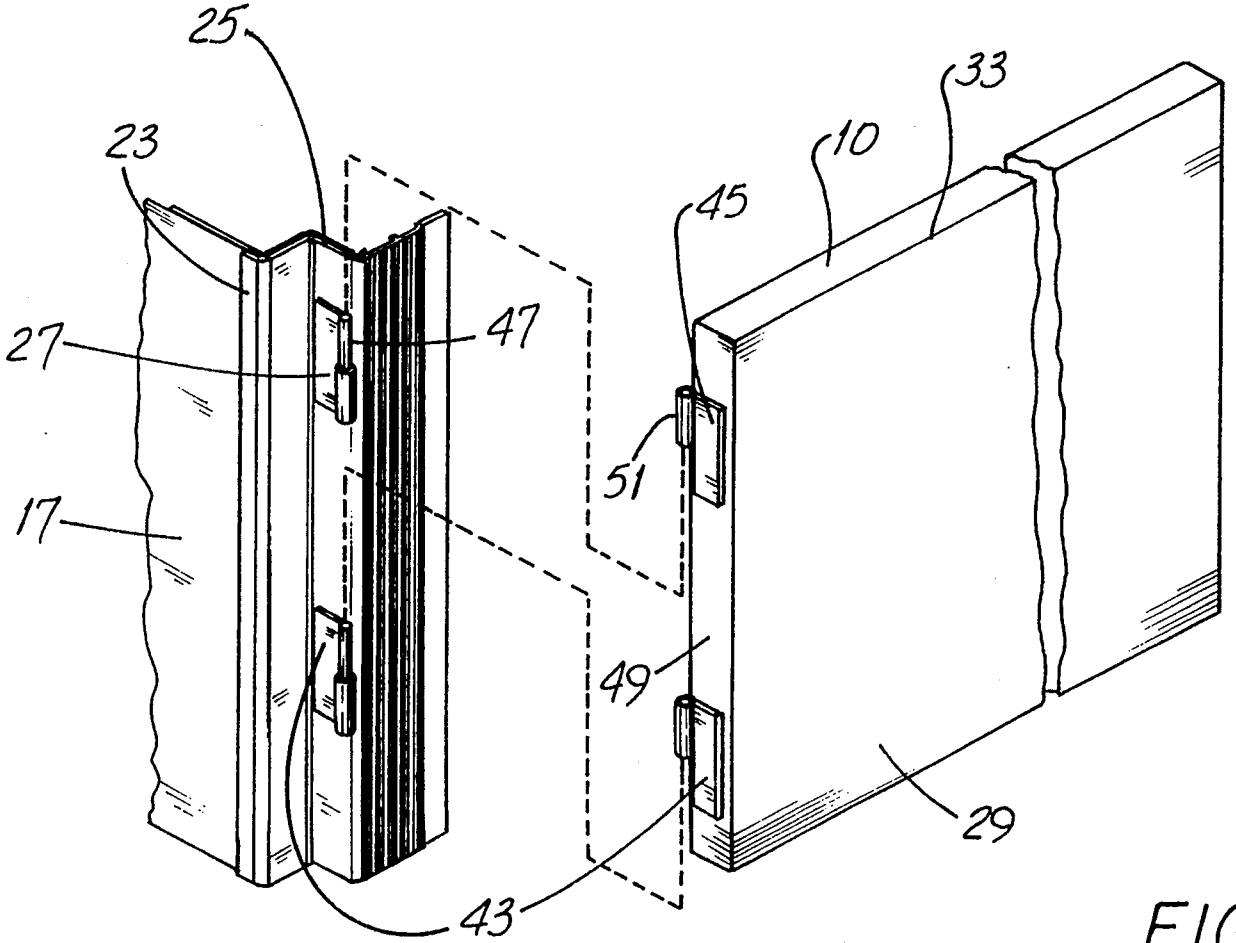
FIG. 2 is a perspective view of a preferred hinge mechanism for an inner compartment door of the freezer of FIG. 1.

Referring also to FIG. 2, the freezer cavity 15 has a freezer liner 17, preferably made of painted cold rolled sheet steel or stainless sheet steel. The cavity 15 is divided into several separate storage compartments 19 and while there are five such compartments 19 in the illustrated exemplary freezer 11, a fewer or greater number of compartments 19 can be used.

The freezer 11 has a plurality of inner doors 10, each closing a separate compartment 19. A "master" outer door 21 covers all of the inner doors 10 and must be opened to gain access to any inner door 10. Each compartment 19 has one or more edge strips 23 known as "thermal breaks" which define a "line of demarcation" between the interior of the compartment 19 and that portion 25 of the freezer 11 on which the first hinge components 27 are mounted- The forward edge(s) of such strip(s) 23 abut and seal against the interior surface 29 of the compartment door 10.

In the exemplary freezer 11, each compartment door 10 is generally rectangular but other door and compartment opening shapes are contemplated by the invention. Such door 10 is preferably fabricated of stainless sheet steel, painted cold rolled sheet steel or plastic.

When the outer door 21 is closed, its interior perimeter edge 31 abuts and seals against the cabinet 13. Similarly, the interior perimeter 33 of each inner compartment door 10 seals against edge strips 23 and the result is a "double barrier" to help prevent migration of ambient air into the freezer 11 and into each inner compartment 19.

Notwithstanding such precautions, a small amount of such ambient air (and vaporized water entrained therein) migrates into each compartment 19 even if the outer door 21 and the inner doors 10 are kept tightly closed for extended periods. Frost forms as a result. If left to accumulate, such frost impairs the ability of the freezer 11 to retain optimum compartment temperature and temperatures in the range of about −55° F. to −300° F. (about −50° C. to −150° C.) are commonly used in laboratory freezers.

Equally notable is the fact that such accumulated frost "packs" between the edges of each inner compartment door 10 and the strips 23. Compartment doors 10 accumulate frost around their perimeters 33 and literally freeze shut with consequent difficulty in opening. And in any event, such frost impairs the air-excluding capability of the inner door-to-cabinet seal so that, when re-closed, the inner compartment door 10 does not seal as well as it might. The invention resolves this difficulty in a unique way.

Figure 3:
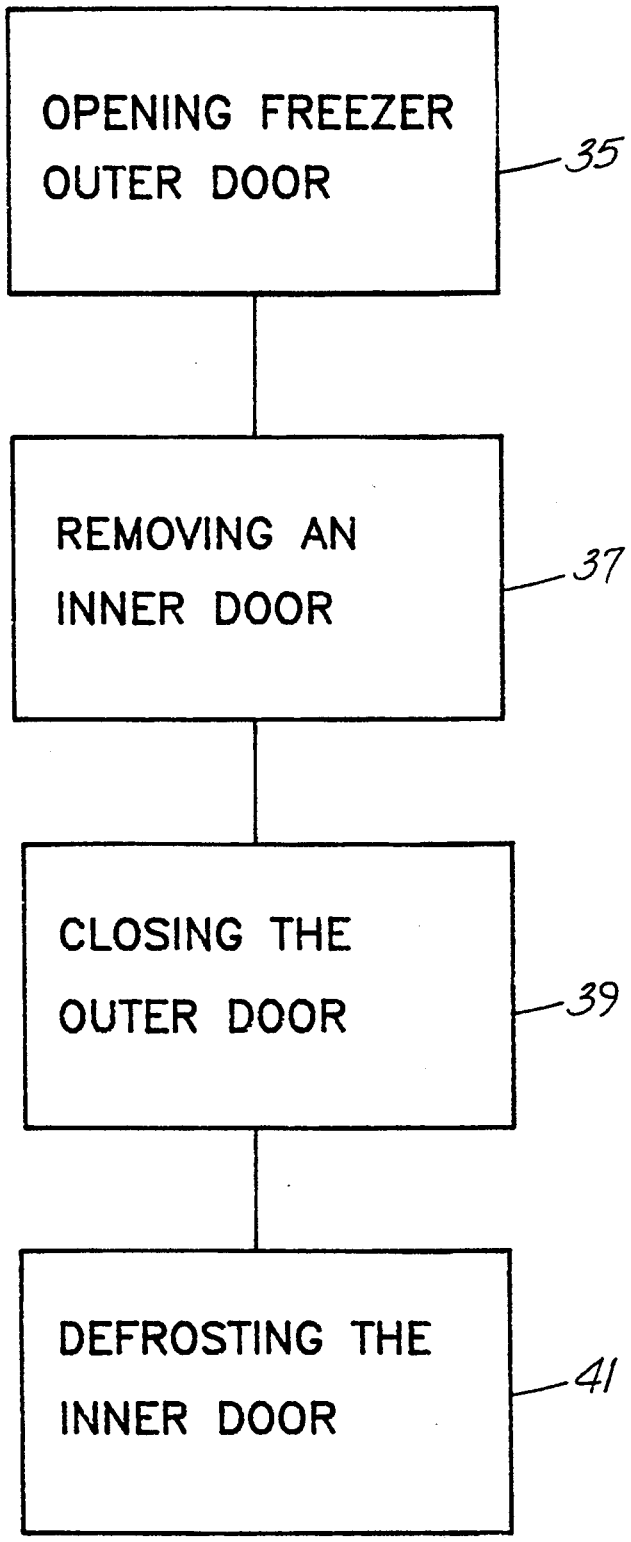
FIG. 3 is a diagram depicting the inventive method.

Referring also to the diagram of FIG. 3, a method for defrosting a laboratory freezer door 10 includes the steps of opening the outer door 21, removing at least one inner door 10, closing the outer door and defrosting the removed inner door. These steps are represented by the symbols 35, 37, 39 and 41, respectively. In this way, an inner door 10 is defrosted without disturbing the contents of the freezer 11 and, particularly, without disturbing the contents of the compartment 19 from which the door 10 is removed. This is a very important result for at least two reasons.

One is that the compartment contents need not be removed to other cold storage facilities. Necessarily, removal of such contents results in at least a brief exposure (and, perhaps, a prolonged exposure) to warmer ambient air and its possibly-deleterious effects on such contents. Another reason why the new method is advantageous is that it avoids the necessity of retaining or providing "spare" temporary cold storage facilities. Such facilities inevitably add cost to the operation of a laboratory and are inconvenient to use—and, with the invention, are unnecessary.

Defrosting of the removed door(s) 10 is in any of a variety of preferred ways. In one aspect of the novel method, the defrosting step includes retaining the removed inner door 10 in a space, e.g., the laboratory room itself, the ambient temperature of which is above the freezing point of water. In due course, the frost melts, the inner door 10 dries and is ready for re-use.

Defrosting may also be by rinsing the removed inner door 10 in a liquid, e.g., tap water, the temperature of which is above the freezing point of water. Or defrosting may be by applying a gas, e.g, air, to the removed inner door 10. The temperature of such gas is above the freezing point of water and, most preferably, the gas is heated by a hot air blower for expeditious defrosting.

The new method contemplates a number of variations. In the variation outlined above, the inner compartment 19 from which the door is removed is devoid of a door 10 while such door 10 is defrosted. This variation is quite satisfactory if the freezer 11 is entered only occasionally and if the inner compartment door 10 is rather quickly defrosted and re-installed. There is then little or no risk of the contents of the compartment 19 "sans door 10" becoming impaired by exposure to ambient air.

On the other hand, if there is a reasonable possibility that the outer door 21 may be opened (especially, opened repeatedly) before the removed door 10 is defrosted for replacement, the user may wish to stock one or more spare doors 10. In that event, the inner door removing step is followed by the step of replacing the removed inner door 10 with a frost-free door 10.

The user may find that more than one inner door 10 needs defrosting at a particular time. In a variation of the method, the door removing step includes removing a first inner door, e.g., door 10*a*, and further includes the steps of removing a second inner door, e.g., door 10*b*, and in either order, replacing the removed inner doors 10*a*, 10*b* with frost-free doors 10. The defrosting step includes defrosting both removed inner doors 10.

In another variant of the method (and irrespective of whether there is one or more inner doors 10 to remove and defrost), the door removing step includes removing a first inner door 10*a* and further includes the steps of replacing the removed first inner door 10*a* with a frost-free door 10, then removing a second inner door 10*b* and replacing the removed second inner door 10*b* with a frost-free door 10. The defrosting step includes defrosting both removed inner doors 10. In this variant, the contents of each inner compartment 19 from which doors 10 are removed are exposed to ambient air for a minimum time since a removed inner door 10 is immediately replaced with a frost-free door 10 before proceeding to remove the next inner door 10.

In a highly preferred method, the door removing step includes detaching the inner door 10 from the freezer 11 without the use of tools. In a freezer well suited for carrying out the new method, at least one of the inner doors 10 has a hinge mechanism 43 including a first hinge component 27 attached to the freezer 11 and a second hinge component 45 attached to the inner door 10. The door removing step includes the step of grasping the inner door 10 and urging the second hinge component 45 away from the first hinge component 27, thereby detaching the inner door 10.

An arrangement facilitating speedy inner door removal without tools, one of the hinge components 27, 45 (e.g., the first component 27 attached to the freezer 11) includes a pin-like projection 47 and the other hinge component 45, 27 (e.g., the second component 45 attached to an edge 49 of the inner door 10) includes a ferrule-like tube 51 for receiving the projection 47. The inner door 10 (with its attached hinge component 45) is lifted slightly upward to "clear" the projection 47 and the tube 51 from one another. Detachment is in seconds and without the use of tools.

While the inventive method has been described in connection with a few preferred variations, it should be understood clearly that such variations are by way of example and are not limiting.

I claim:

1. A method for defrosting an inner door of a laboratory freezer having (a) a plurality of inner doors, each closing a separate compartment, and (b) an outer door covering the inner doors, the method including the steps of:

opening the outer door;

removing at least one inner door;

closing the outer door; and, defrosting the removed inner door, whereby an inner door is defrosted without disturbing the contents of the freezer.

2. The method of claim 1 wherein the defrosting step includes retaining the removed inner door in a space, the ambient temperature of which is above the freezing point of water.

3. The method of claim 1 wherein the defrosting step includes rinsing the removed inner door in a liquid, the temperature of which is above the freezing point of water.

4. The method of claim 1 wherein the defrosting step includes applying a gas to the removed inner door, the temperature of the gas being above the freezing point of water.

5. The method of claim 4 wherein the gas is heated air.

6. The method of claim 1 wherein the inner door removing step is followed by the step of replacing the removed inner door with a frost-free door.

7. The method of claim 1 wherein the door removing step includes removing a first inner door and further includes the steps of:

removing a second inner door; and, replacing the removed inner doors with frost-free doors;

and the defrosting step includes defrosting both removed inner doors.

8. The method of claim 1 wherein the door removing step includes removing a first inner door and further includes the steps of:

replacing the removed first inner door with a frost-free door;

removing a second inner door; and, replacing the removed second inner door with a frost-free door, and the defrosting step includes defrosting both removed inner doors.

9. The method of claim 8 wherein the defrosting step includes rinsing the removed inner doors in a liquid, the temperature of which is above the freezing point of water.

10. The method of claim 1 wherein the door removing step includes detaching the inner door from the freezer without the use of tools.

11. The method of claim 10 wherein:

at least one of the inner doors has a hinge mechanism including a first hinge component attached to the freezer and a second hinge component attached to the inner door, and the door removing step includes the step of:

lifting the inner door to urge the second hinge component away from the first hinge component, thereby detaching the inner door.

12. The method of claim 11 wherein one of the hinge components includes a pin-like projection and the other hinge component includes a ferrule-like tube for receiving the projection.

* * * * *

UNITED STATES PATENT AND TRADEMARK OFFICE

CERTIFICATE OF CORRECTION

PATENT NO. : 5,339,643

DATED : August 23, 1994

INVENTOR(S) : Jeffrey A. Pikaart and Daniel J. O'Keefe

It is certified that error appears in the above-indentified patent and that said Letters Patent is hereby corrected as shown below:

On the title page under "inventor", please add --Daniel J. O'Keefe, Holland, Mich.--.

Signed and Sealed this

Fifteenth Day of November, 1994

*Attest:*

*Attesting Officer*

BRUCE LEHMAN

*Commissioner of Patents and Trademarks*